United States Patent [19]

Carlsen, II

[11] 4,310,731

[45] Jan. 12, 1982

[54] THERMAL MOTION TRANSDUCER

[75] Inventor: George D. Carlsen, II, Hawthorne, Calif.

[73] Assignee: Dynamic Compliance, Incorporated, Santa Monica, Calif.

[21] Appl. No.: 63,058

[22] Filed: Aug. 2, 1979

[51] Int. Cl.[3] ..... H04R 15/00

[52] U.S. Cl. ..... 179/110 F; 179/110 R; 318/117

[58] Field of Search ..... 324/104, 105; 179/110 R, 110 F, 113; 310/306, 15; 318/117

[56] References Cited

U.S. PATENT DOCUMENTS

| | | | |
|---|---|---|---|
| 543,313 | 7/1895 | Patrick | 179/113 |
| 1,292,105 | 1/1919 | Shoenberg | 318/117 |
| 1,834,498 | 12/1931 | Parshall | 179/110 R |
| 2,263,308 | 11/1941 | Mason | 179/110 F |
| 2,555,882 | 6/1951 | Guajardo | 318/117 |
| 2,777,077 | 1/1957 | Lorini | 318/117 |
| 2,926,293 | 2/1960 | Camm et al. | 318/117 |

FOREIGN PATENT DOCUMENTS

| | | | |
|---|---|---|---|
| 96975 | 7/1897 | Fed. Rep. of Germany | 324/104 |
| 318708 | 9/1929 | United Kingdom | 179/113 |

OTHER PUBLICATIONS

"Electrostrictive Ceramics," by Turner, *Radio -Electronics* for Sep. 1959, pp. 30-31.

*Primary Examiner*—Thomas A. Robinson
*Attorney, Agent, or Firm*—Kenneth W. Float

[57] ABSTRACT

A source of driving signals is coupled to a thermal transducer wire to provide a completed circuit. The source may include a DC bias supply and an audio amplifier. The bias supply heats the wire to a predetermined temperature, and the amplifier heats and cools the wire above and below the predetermined temperature. The wire expands and contracts in response to the audio signals, thus providing for acoustic reproduction thereof. The wire may be coupled to a diaphragm, such as a conventional speaker cone, to accomplish the acoustic reproduction. A lever arrangement coupled between the wire and the diaphragm may be employed to obtain increased diaphragm motion. A lever arrangement employing two wires in a push-pull configuration is also provided for obtaining increased motion. Additionally, a true RMS meter and a relay are provided which incorporate the heated wire thermal motion arrangement.

14 Claims, 9 Drawing Figures

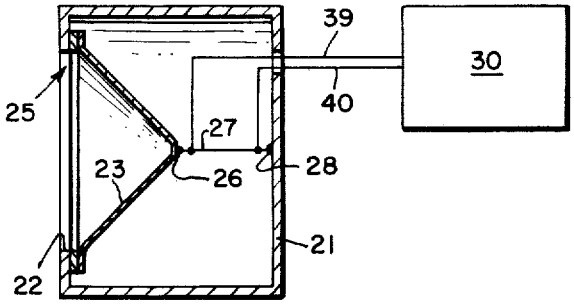
Fig. 1a.
Fig. 1b.
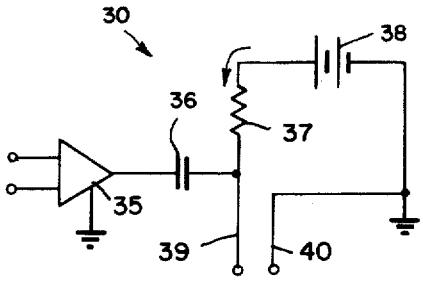
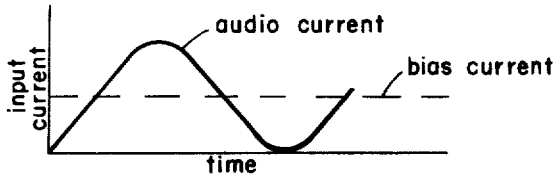
Fig. 1c.
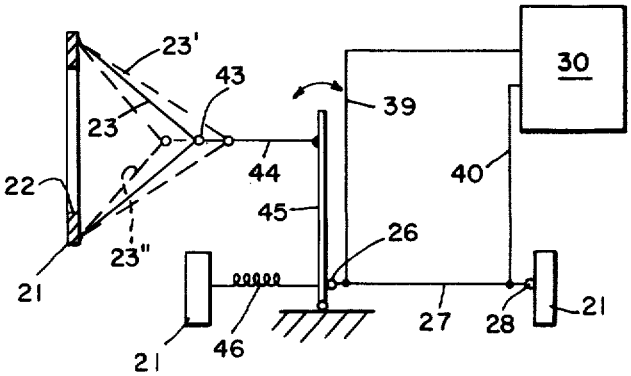
Fig. 2.
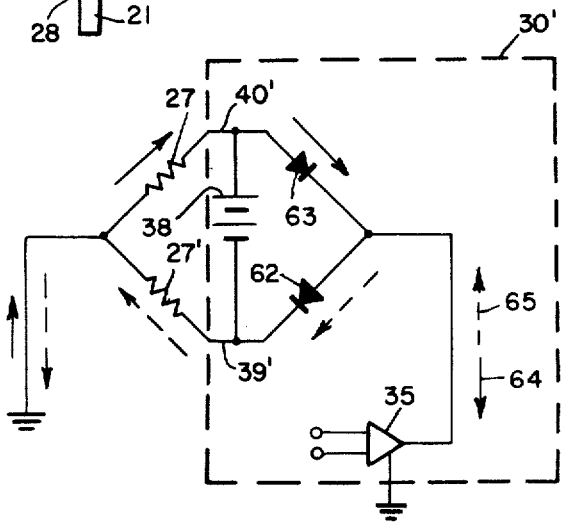
Fig. 3b.

Fig. 3a.
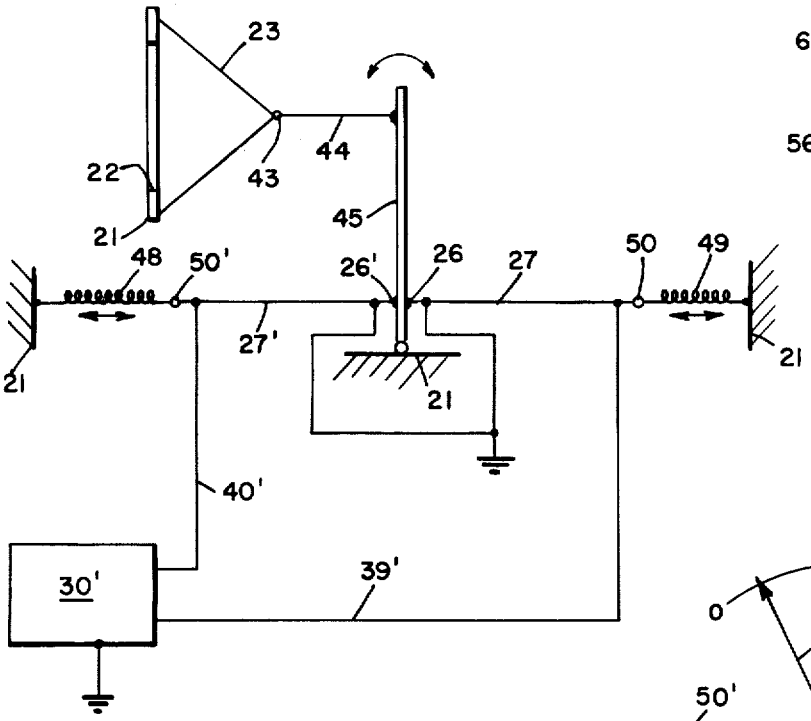
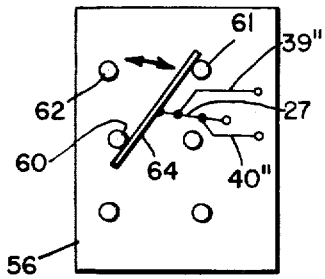
Fig. 5.
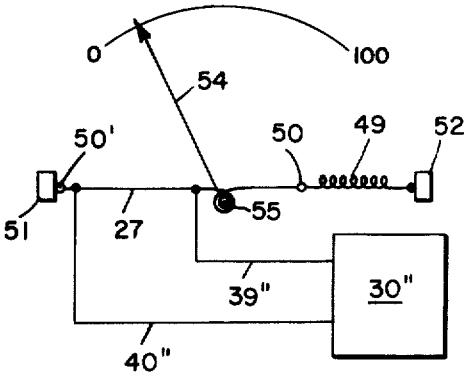
Fig. 4.
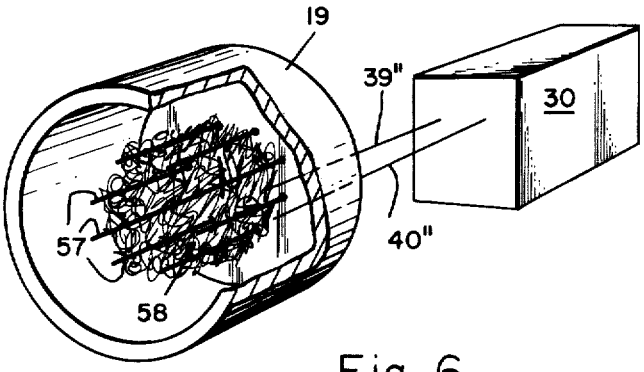
Fig. 6.

THERMAL MOTION TRANSDUCER

BACKGROUND

By and large, most present-day audio speakers employ a permanent magnet and a voice coil to drive a speaker cone in response to audio signals. The magnets used in these speakers are generally a costly component. There is also an increasing shortage of cobalt, which is used to make alnico magnets, the most commonly used magnets for loudspeakers. This shortage is driving the price of magnets to an extremely high value so as to make it desirable to have an alternative means of driving the speaker cone. In oder to obtain high speaker efficiencies, it is necessary to have tight tolerances in the cone/magnet interface, which also results in higher manufacturing costs. There is also substantial interest in nonmagnetic speakers by manufacturers of audio systems due to the above cost and manufacturing problems. In addition, relays and meter movements, and the like, also incorporate magnets which are affected by the cobalt shortage, resulting in higher prices for these devices.

SUMMARY OF THE INVENTION

Accordingly, it is an object of the present invention to provide a thermal motion transducer which controls motion of apparatus attached thereto.

It is another object of the present invention to provide an audio speaker which does not incorporate magnetic components.

It is a further object of the present invention to provide a relay or meter movement which requires no magnetic components.

In accordance with these and other objects of the present invention, there is provided a thermal motion transducer comprising a source of driving signals coupled to a length of thermal transducer wire so as to provide a completed electrical circuit. The source heats the wire to a predetermined temperature and additionally heats and cools the wire above and below the predetermined temperature. The wire thus has an equilibrium length determined by the predetermined temperature and an expanded and contracted length determined by the heating and cooling above and below the predetermined temperature. The expanding and contracting of the wire causes motion thereof in response to the driving signals.

The source of driving signals includes a source of direct current bias signals for heating the wire to the predetermined temperature and a source of audio signals for heating the wire above and below the predetermined temperature. Accordingly, the motion of the wire provides acoustic reproduction of the audio signals.

One embodiment of the present invention is a loudspeaker system which comprises an enclosure having an aperture and a diaphragm rigidly attached around the inner periphery of the aperture. The wire is insulatably attached to both the diaphragm and the interior of the enclosure opposite the aperture and is stretched tautly therebetween. The source of driving signals is coupled to opposite ends of the wire and incorporates both the bias and audio signal sources. Operationally, the relative motion of the wire produced by the heating and cooling thereof provides acoustic reproduction of the audio signals.

To provide increased motion of the diaphragm, and hence a more powerful loudspeaker, mechanical advantage means may be used with the system described above. One such means may comprise a lever having one end pivotably attached to the enclosure. A tie rod is connected between the diaphragm and the distal end of the lever. The wire, along with tensioning means, such as a spring, is attached to the lever near the proximal end thereof in an opposed manner. The wire and spring are attached to the enclosure collinearly. The spring thus exerts forces on the lever which assist or resist motion thereof in response to the expansion and contraction of the wire.

Increased motion of the diaphragm may be accomplished by the use of a lever operated in a push-pull manner. A third embodiment provides a loudspeaker incorporating just such an arrangement wherein the lever is driven by a collinear arrangement of two springs and two wires. The springs are attached to opposite sides of the enclosure, and each spring is connected to one of the wires. The wires are connected to opposite sides of the lever near the proximal end in an opposed manner such that the combination assists the motion of the lever. The source of driving signals is connected to the wires so as to allow positive half-cycles of the driving signals to expand one wire and negative half-cycles to contract the other wire. The wires remain in an equilibrium length when not being expanded or contracted.

A true RMS meter may be constructed in accordance with the principles of the present invention. The meter comprises a pointer rotatably attached to an enclosure by means of a shaft. A wire and spring combination is arranged in a collinear manner to rotate the pointer. The wire and spring are attached together and stretched across the enclosure and anchored to opposite sides thereof. The wire is frictionally coupled to the shaft of the pointer by having a portion thereof wrapped around the shaft. The source of driving signals is connected across the length of wire extending between the enclosure and the shaft. The source of driving signals heats that length of wire causing expansion thereof. The linear expansion of the wire is translated into rotational motion of the pointer due to the frictional coupling of the wire to the pointer shaft. Accordingly, the pointer moves in response to the driving signals, as determined by the expansion and contraction of the wire.

A relay may also be constructed in employing the thermal motion transducer of the present invention. A movable switching arm switches an electrical connection from a first contact to a second contact. The thermal motion wire is physically anchored between the enclosure and the movable switching arm and is electrically connected across the source of driving signals. Upon application of the driving signals, the switching arm is caused to move from the first position to the second position, and vice versa upon removal of the signals.

BRIEF DESCRIPTION OF THE DRAWINGS

The invention, including its various objects, features and advantages, may be more readily understood with reference to the following description of several embodiments, taken in conjunction with the accompanying drawings, wherein like reference numerals designate like structural elements, and in which:

FIG. 1*a* illustrates an audio loudspeaker system made in accordance with the principles of the present invention;

FIG. 1*b* illustrates a driving circuit for use with the audio loudspeaker system of FIG. 1*a;*

FIG. 1*c* shows a graph of input current versus time associated with the circuit of FIG. 1*b;*

FIG. 2 shows a second embodiment of the present invention incorporating mechanical advantage means;

FIG. 3*a* illustrates a speaker incorporating a second mechanical advantage means;

FIG. 3*b* illustrates a circuit for use in the system of FIG. 3*a;*

FIG. 4 illustrates a true RMS meter made in accordance with the principles of the present invention;

FIG. 5 illustrates a relay made in accordance with the principles of the present invention; and FIG. 6 illustrates another embodiment of an audio loudspeaker system made in accordance with the principles of the present invention.

DETAILED DESCRIPTION OF THE INVENTION

Referring now to FIG. 1*a*, there is shown an audio loudspeaker arrangement comprising an enclosure 21 having an aperture 22. The enclosure may be made of wood, plastic, or any substantially rigid material. A diaphragm such as a loudspeaker cone 23 is rigidly attached around the inner periphery of the aperture 22, in the area indicated by arrow 25. An insulating bead 26, such as glass, or the like, is attached to the apex of the speaker cone 23 by means of glue, or the like, and a second insulating bead 28 is attached to the interior of the enclosure 21 opposite the aperture 22.

A length of electrical wire 27 is stretched tautly between the two insulating beads 26, 28. The wire 27 may be any conventional wire, such as nichrome or copper, or the like. The length and diameter of the wire 27 is determined by the speaker application. For high frequency response, the wire 27 is generally small in diameter and short in length. For lower frequency response or if considerable motion is required, the wire 27 has a much longer length and/or a larger diameter. A source of driving signals 30, such as a source of audio signals coupled with a source of direct current bias signals, is provided having output leads 39, 40 attached to opposite ends of the wire 27.

Referring now to FIG. 1*b*, there is shown an embodiment of a source of driving signals 30 for use in the speaker arrangement of FIG. 1*a*. There is generally provided a differential audio amplifier 35 having its output coupled through a capacitor 36 to the wire 27 by way of the output lead 39. The electrical lead 39 is also connected through a resistor 37 to one end of a source of DC bias signals 38. The other end of the source of DC bias signals 38 is connected to the other end of the wire 27 by means of the output lead 40 and is also connected to the common ground of the differential amplifier 35.

Referring to FIG. 1*c*, there is shown a graph of input current versus time for the electrical circuit shown in FIG. 1*b*. Generally, the source of DC bias signals 38 provides bias current, as shown by the dashed line, while the audio amplifier 35 provides audio current fluctuating above and below this bias current. The bias current should be of sufficient magnitude to preclude clipping of the autio current signals during the negative half-cycles.

In operation, the source of direct current bias signals 38 heats the wire 27 to a predetermined temperature. This predetermined temperature corresponds to a predetermined length of the wire 27. Any conventional audio amplifier, such as manufactured by Sony or Marantz, or the like, may be used. These amplifiers generally include both current sources as part of the circuit, which may be adapted for use with the loudspeaker of the present invention. The audio amplifier 35 provides alternating current signals which heat and cool the wire 27 above and below the predetermined temperature on alternating half-cycles thereof. This additional heating and cooling of the wire 27 provides for expanding and contracting of the wire 27 about its predetermined length. The expanding and contracting of the wire 27 provides relative motion for the speaker cone 23 attached thereto. Accordingly, acoustic reproduction of the audio signals provided by the audio amplifier 35 is induced in the speaker cone 23. This speaker arrangement has a frequency response in the range of 0–10 kHz with an anticipated frequency response capability approaching 20 kHz.

Referring now to FIG. 2, there is shown a second embodiment of the present invention which additionally incorporates means for providing increased motion of the diaphragm. The embodiment of FIG. 2 is substantially the same as that of FIG. 1, but includes mechanical advantage means, such as a lever 45, or the like, having a portion thereof pivotably coupled to the enclosure 21. A substantially nonstretchable member, such as a tie rod 44, or the like, is connected between the apex of the speaker cone 23 and the distal end of the lever 45. Both the lever 45 and the rod 44 should be made of relatively lightweight material, such as aluminum, rigid plastic, or the like. Tensioning means, such as a spring 46, is attached between the enclosure 21 and the lever 45 at a point near the proximal end thereof. The wire 27 is insulatably attached between the lever 45 and the enclosure 21 by means of the glass beads 26, 28 and is aligned so as to be collinear with and oppositely disposed from the spring 46. The orientation of the spring 46 and the wire 27 is such as to assist or resist the motion of the lever 45, and hence the speaker cone 23. The source of driving signals 30, which may be the circuit of FIG. 1*b*, has the output leads 39, 40 thereof connected to opposite ends of the wire 27.

The operation of the embodiment of FIG. 2 is generally the same as that of FIGS. 1*a*, 1*b* and 1*c*. Accordingly, the source of driving signals 30 heats and cools the wire 27 which operates in conjunction with the spring 46 to move the lever 45. A small amount of motion induced by the wire/spring combination causes increased motion of the speaker cone 23 in proportion to the length of the moment arm of the lever 45. The spring 46 provides substantial force for assisting or resisting the motion of the lever 45 when the wire 27 is contracted or expanded. Accordingly, the speaker cone 23 is provided with increased motion, as indicated by the dashed speaker cones 23' and 23''. The position indicated by 23' is associated with a contracted wire 27, while the position indicated as 23'' is associated with an expanded length of wire 27.

Referring now to FIG. 3*a*, there is provided an audio loudspeaker arrangement which also provides for increased motion of the diaphragm. The speaker embodiment of FIG. 3*a* incorporates a lever arrangement of FIG. 2 but wherein the lever 45 is driven in a push-pull manner. Accordingly, two electrical wires 27, 27' and two springs 48, 49 are arranged in a collinear manner to assist the motion of the lever 45, and hence the motion of the speaker cone 23.

The springs 48, 49 each have one end thereof attached to the enclosure 21 at points generally opposite one another. One wire 27 is insulatably connected between the lever 45 and the other end of one spring 49 by means of insulating beads 26, 50, or the like. The other wire 27' is insulatably connected between the lever 45 and the other end of the other spring 48 by means of insulating beads 26', 50', or the like. The wires 27, 27' are connected to the lever 45 opposite one another near the proximal end. A source of driving signals 30' has its output leads 39', 40' separately connected to ends of the wires 27, 27' and has its common ground connected to the other ends of the wires 27, 27'.

Referring now to FIG. 3*b*, there is shown an electrical circuit for use with the speaker of FIG. 3*a*. Generally, the circuit includes a differential audio amplifier 35 having its output connected to one end of a bridge circuit which comprises two diodes 62, 63, a source of DC bias signals 38, and the two wires 27, 27'. The output of the amplifier 35 is connected to the positive end of diode 62 and to the negative end of diode 63. The source of DC bias signals is connected between the negative end of diode 62 and the positive end of diode 63. The output leads 39', 40' are connected to opposite ends of the source of bias signals 38 and separately connected to one end of the wires 27', 27, respectively. The other ends of the wires 27, 27' are connected to the common ground return of the amplifier 35.

The operation of the circuit of FIG. 3*b* is such that the source of DC bias signals 38 provides voltage sufficient to cause conduction in the two diodes 62, 63. Referring to FIG. 1*c*, the audio amplifier 35 provides an audio current signal such as shown therein, when the signal is a positive half cycle, such as indicated above the bias current line, the current through the circuit of FIG. 3*b* follows the path indicated by solid arrows 64. During the second half cycle below the bias current level, the current follows a path indicated by the dashed arrows 65.

Thus, the operation of the embodiment of FIG. 3*a* provides that, during the positive half cycle of the audio signal, the second electrical wire 27' is in an expanded condition, while the first electrical wire 27 is at an equilibrium length. During the negative half cycles of the audio current, the first wire 27 is in a contracted condition, while the second wire 27' is at an equilibrium length. Accordingly, the two wires 27, 27' alternately expand and contract, and with the assistance of the two springs 48, 49, provide for motion of the lever 45. As in the second embodiment, a relatively small amount of motion of the lever 45 provided by the push-pull arrangement provides for increased motion of the loudspeaker cone 23. The frequency response characteristics are similar to those of the embodiments of FIGS. 1*a*, 1*b* and 1*c*.

Referring now to FIG. 4, there is shown a true RMS meter made in accordance with the principles of the present invention. The meter generally comprises a base having two anchoring points 51, 52 and the length of wire 27 having one end insulatably attached to one anchoring point 51 by means of an insulating bead 50'. A meter movement 54 has one end thereof rotatably attached to the base about a shaft 55. The wire 27 is frictionally coupled to the shaft 55 by wrapping the wire at least one time therearound. Tensioning means, such as a spring 49, has one end attached to the other anchoring point 52 and the other end insulatably attached to the other end of the wire 27 by means of an insulating bead 50. An enclosure may be provided for housing for protecting the components of the meter. A source of driving signals 30'', such as provided by the circuit of FIG. 1*b*, is connected across the length of wire 27 extending between anchoring point 51 and the shaft 55.

In operation, and with no current provided by the source of driving signals 30'', the wire 27 is completely contracted, and the meter movement 54 is in a first position generally corresponding to a zero position on an indication dial. Once current is provided by the source of driving signals 30'', the wire 27 is heated and accordingly expands to a new length determined by the amount of current provided thereto. The expansion in length is translated into rotational motion of the meter movement 54 by the frictional coupling of the wire 27 to the shaft 55. The spring 49 assists the motion of the meter movement 54 during the heating period. The current provided to the wire 27 may be either AC or DC. Also, the wire is generally sized such that the thermal response is slow enough at the lowest AC operating frequency to exhibit minimum oscillation of the meter movement 54. The meter directly indicates the heating value of any current waveform applied thereto, from DC to the most complex AC waveform.

Referring now to FIG. 5, there is shown a relay which is substantially the same as a conventional relay, but incorporates the thermal motion transducer of the present invention. The relay generally comprises a base 56 having three conductive elements 60, 61, 62 disposed thereon. A movable conductive member 64, or switching arm, is conductively connected to the first and second conductive elements 60, 61 when in a first position and conductively connected to the first and third conductive elements 60, 62 when in a second position. The wire 27 has one end insulatably attached to the movable conductive member 64 and has the other end insulatably attached to the base 56. A current source (not shown), which may be similar to the source used in the prior embodiment, is connected across the wire 27 by means of output leads 39'', 40''.

In operation, the movable conductive member 64 is in the first position when no current is applied to the wire 27. Upon application of current to the wire 27, it expands so as to allow the movable conductive member 64 to move into the second position and be in contact with the first and third conductive elements 60, 62. Once current is removed from the wire 27, the movable conductive member 64 returns to the first position in contact with the first and second conductive elements 60, 61.

Referring now to FIG. 6, there is shown another embodiment of a loudspeaker arrangement made in accordance with the principles of the present invention. Generally, there is provided an enclosure 19 having an aperture therein and having a plurality of insulating pins 57 disposed therein. A continuous length of wire 58 is wrapped around the insulating pins 57 in a manner so as to expose the maximum amount of surface area of the wire 58 to the surrounding air. A source of driving signals 30 is provided and has output leads 39, 40 attached to opposite ends of the wire 58. The source of driving signals 30 generally includes a source of direct current bias signals and a source of audio signals, such as shown in FIG. 1*b*.

In operation, the wire 58 is heated to a predetermined temperature by the direct current bias signals, and the audio current signals heat and cool the wire 58 above and below the predetermined temperature. The wire 58 thus heats and cools the surrounding air causing the air pressure within the enclosure 19 to increase and decrease in response thereto. Accordingly, acoustic reproduction of the audio signals is provided. The frequency response of this arrangement is in the range of 0–5,000 Hz and is very well-suited for headphone use.

Thus, there have been described several embodiments of an audio loudspeaker arrangement which does not require a magnet to provide driving signals to the loudspeaker cones and one which requires no speaker cone at all. In addition, the embodiments of a meter movement and a relay movement have been provided in accordance with the principles of the present invention. The relay is less complex and may be smaller in size than conventional relays. The true RMS meter is also less complex and less expensive. The meter is also responsive to current waveforms which are simple DC signals or to the most complex AC waveform.

It is to be understood that the above-described embodiments of the invention are merely illustrative of the many possible specific embodiments which represent applications of the principles of the present invention. Clearly, numerous and varied other arrangements can readily be devised in accordance with these principles by those skilled in the art without departing from the spirit and scope of the invention.

What is claimed is:

1. A thermal motion transducer comprising:

a length of electrical wire; and a source of driving signals coupled to said wire so as to complete an electrical circuit therethrough, for heating said wire to a predetermined temperature and for heating said wire above and below said predetermined temperature, said wire having an equilibrium length determined by said predetermined temperature and an expanded and contracted length determined by said heating above and below said predetermined temperature, such expanding and contracting causing a change in length of said wire in response to said driving signals.

2. The thermal motion transducer of claim 1 wherein said source of driving signals comprises a source of direct current signals for heating said wire to said predetermined temperature, and a source of alternating signals for heating said wire above and below said predetermined temperature, said change in length of said wire providing reproduction of said alternating signals.

3. The thermal motion transducer of claim 2 further comprising an enclosure having an aperture, said wire being disposed within said enclosure.

4. The thermal motion transducer of claim 3 further comprising a diaphragm disposed within said enclosure having the periphery thereof rigidly attached around said aperture, one end of said wire being insulatably attached to said diaphragm, and the other end of said wire being insulatably attached to said enclosure opposite said aperture, said wire being stretched tautly therebetween.

5. The thermal motion transducer of claim 4 wherein said diaphragm comprises a loudspeaker cone.

6. The thermal motion transducer of claim 1 further comprising:

a movable member having one end rotatably attached to an enclosure, said wire being frictionally coupled to said movable member around said rotatable attachment, said wire having one end insulatably attached to said enclosure;

tensioning means having one end attached to said enclosure and having the other end insulatably attached to the other end of said wire;

said source of driving signals being connected to said wire at a point adjacent to said enclosure and connected at a point along said wire prior to said rotatable attachment.

7. A speaker arrangement comprising:

an enclosure having an aperture;

a diaphragm disposed within said enclosure and having the periphery thereof rigidly attached around said aperture;

a length of electrical wire having one end attached to said enclosure;

a source of driving signals coupled to said wire so as to complete an electrical circuit therethrough, for heating said wire to a predetermined temperature and heating said wire above and below said predetermined temperature, said wire having an equilibrium length determined by said predetermined temperature and an expanded and contracted length determined by said heating above and below said predetermined temperature, said source of driving signals comprising a source of direct current signals for heating said wire to said predetermined temperature, and a source of audio signals for heating said wire above and below said predetermined temperature;

mechanical advantage means for providing increased motion of said diaphragm, said mechanical advantage means being coupled to said diaphragm and insulatably coupled to the other end of said wire, said mechanical advantage means having a portion thereof pivotably attached to said enclosure.

8. The speaker arrangement of claim 7 wherein said mechanical advantage means comprises a rigid member having one end thereof pivotably attached to said enclosure, a substantially nonstretchable member attached to the distal end thereof, the other end of said nonstretchable member being attached to said diaphragm, and a spring member having one end attached to said enclosure and having the other end attached to the proximal end of said rigid member, said spring member exerting forces on said rigid member so as to assist and resist motion thereof in response to said expanding and contracting of said wire.

9. A speaker arrangement comprising:

an enclosure having an aperture;

a diaphragm disposed within said enclosure and having the periphery thereof rigidly attached around said aperture, said diaphragm having an attachment point thereon;

mechanical advantage means for providing increased motion of said diaphragm, said mechanical advantage means having one portion pivotably coupled to said enclosure and having another portion distal from said pivotably coupled portion coupled to said attachment point, said mechanical advantage means including tensioning means insulatably coupled to the other ends of said first and second wires and coupled to said enclosure in an opposed manner for providing tension to assist and resist the motion of said mechanical advantage means;

first and second wires each having one end insulatably attached to said mechanical advantage means proximal to said pivotably coupled portion, said first and second wires being oppositely disposed and having the other ends separately coupled to said first and second tensioning means; and a source of driving signals coupled to said wires so as to complete an electrical circuit therethrough, for heating said wires to a predetermined temperature and for heating one of said wires above said predetermined temperature, and cooling the other of said wires below said predetermined temperature, said wires having an equilibrium length determined by said predetermined temperature and an expanded and contracted length determined by said heating above and below said predetermined temperature, said source of driving signals comprising a source of direct current signals for heating said wires to said predetermined temperature, and a source of audio signals for heating said wires above and below said predetermined temperature.

10. A thermal motion transducer comprising:

an enclosure;

first, second and third conductive elements disposed in said enclosure;

a movable conductive member connected to said first and second conductive elements when in a first position and connecting said first and third conductive elements when in a second position;

an electrical wire having one end insulatably attached to said movable conductive member and having the other end insulatably attached to said enclosure;

a source of current signals coupled to opposite ends of said wire so as to complete an electrical circuit therethrough, whereupon application of current signals to said wire causes expansion thereof, said movable member responding thereto by moving from said first position to said second position, said movable member returning to said first position upon termination of said current signals.

11. A thermal motion transducer comprising:

a length of electrical wire; and a source of driving signals coupled to said wire so as to complete an electrical circuit therethrough, for heating said wire to a predetermined temperature and for heating said wire above and below said predetermined temperature, said source of driving signals comprising a source of direct current signals for heating said wire to said predetermined temperature, and a source of alternating signals for heating said wire above and below said predetermined temperature, said wire having an equilibrium length determined by said predetermined temperature and an expanded and contracted length determined by said heating above and below said predetermined temperature, such expanding and contracting causing a change in length of said wire in response to said driving signals.

12. The thermal motion transducer of claim 11 further comprising an enclosure having an aperture, said wire being disposed within said enclosure.

13. The thermal motion transducer of claim 12 further comprising a diaphragm disposed within said enclosure having the periphery thereof rigidly attached around said aperture, one end of said wire being insulatably attached to said diaphragm, and the other end of said wire being insulatably attached to said enclosure opposite said aperture, said wire being stretched tautly therebetween.

14. The thermal motion transducer of claim 13 wherein said diaphragm comprises a loudspeaker cone.

* * * * *